US010113546B2

(12) United States Patent
Klimes et al.

(10) Patent No.: US 10,113,546 B2
(45) Date of Patent: Oct. 30, 2018

(54) PUMP FOR AN ENGINE

(71) Applicant: Caterpillar Inc., Peoria, IL (US)

(72) Inventors: Michael D. Klimes, Lafayette, IN (US); Corey E. Baxter, Lafayette, IN (US); Daniel S. Brandt, Lafayette, IN (US)

(73) Assignee: Caterpillar Inc., Deerfield, IL (US)

( * ) Notice: Subject to any disclaimer, the term of this patent is extended or adjusted under 35 U.S.C. 154(b) by 101 days.

(21) Appl. No.: 15/237,734

(22) Filed: Aug. 16, 2016

(65) Prior Publication Data

US 2018/0051695 A1 Feb. 22, 2018

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 14/24*** | (2006.01) |
| ***F04C 15/00*** | (2006.01) |
| ***F04C 2/08*** | (2006.01) |
| ***F04C 2/14*** | (2006.01) |
| ***F04C 14/18*** | (2006.01) |
| ***F04C 2/18*** | (2006.01) |

(52) U.S. Cl.

CPC ..... *F04C 14/24* (2013.01); *F04C 2/088* (2013.01); *F04C 2/14* (2013.01); *F04C 2/18* (2013.01); *F04C 14/18* (2013.01); *F04C 15/0026* (2013.01); *F04C 15/0042* (2013.01); *F04C 2240/30* (2013.01); *F04C 2270/18* (2013.01)

(58) Field of Classification Search

CPC ..... F04C 14/18; F04C 14/20; F04C 14/22; F04C 14/24; F04C 2/084; F04C 2/088; F04C 2/14; F04C 15/0026; F04C 15/0042; F04C 2240/30

USPC ..... 418/21, 24–27, 71–74, 189–190, 418/206.1–206.8

See application file for complete search history.

(56) References Cited

U.S. PATENT DOCUMENTS

| | | | |
|---|---|---|---|
| 4,740,142 | A | 4/1988 | Rohs et al. |
| 7,137,798 | B2 | 11/2006 | Goetschhofer |
| 7,654,806 | B2 | 2/2010 | Hanst et al. |
| 8,899,951 | B2 | 12/2014 | Friedrich |

FOREIGN PATENT DOCUMENTS

| | | | | |
|---|---|---|---|---|
| DE | 102008025346 | A1 * | 12/2009 | ..... F04C 14/18 |
| DE | 102011009221 | A1 * | 7/2012 | ..... F04C 2/14 |

OTHER PUBLICATIONS

DE 102011009221 A1—Kramer Bjoern et al.—Zahnradpumpe—Jul. 26, 2012—Englsih Translation.*

* cited by examiner

*Primary Examiner* — Theresa Trieu

(57) ABSTRACT

A pump for an engine includes a suction chamber, a discharge chamber, and a piston at least partly received within a relief chamber. The piston has first and second passageways provided therein. The second passageway is located closer to a face of the piston than the first passageway. The piston is movable within the relief chamber, so that the volume of the fluid transfer from the suction chamber to the discharge chamber is varied according to a pressure in the relief chamber. The first and second passageways form fluid paths between the suction chamber and the discharge chamber at a first and second pressure in the relief chamber, respectively, the first pressure being less than the second pressure.

17 Claims, 6 Drawing Sheets

PUMP FOR AN ENGINE

TECHNICAL FIELD

The present disclosure relates to a pump for an engine and to a piston for an engine pump.

BACKGROUND

Variable displacement pumps are known for their versatility of use in varying a displacement of fluid output therefrom. One type of variable displacement pump used in engines is a variable displacement gear pump. A conventional variable displacement gear pump may function to vary a displacement of fluid by the pump within its operating range. In some cases, a pressure relief valve may be provided at the output of the pump, to ensure the output pressure does not exceed a safe working pressure for the pump or downstream systems.

U.S. Pat. No. 8,899,951 discloses a variable displacement gear pump having a pump chamber and a regulating chamber. These chambers are separated from each other by a piston that is axially displacable according to a pressure differential between the pump and regulation chambers. One gear of the pump moves with the piston to vary the displacement of the pump.

SUMMARY OF THE DISCLOSURE

In an aspect of the present disclosure, a pump for an engine includes a suction chamber, a discharge chamber, and a piston at least partly received within a relief chamber. The piston has first and second passageways provided therein. The second passageway is located closer to a face of the piston than the first passageway. The piston is movable within the relief chamber according to a pressure in the relief chamber. The first and second passageways form fluid paths between the suction chamber and the discharge chamber at a first and second pressure in the relief chamber, respectively, the first pressure being less than the second pressure.

In another aspect of the present disclosure, a piston for an engine pump includes first and second passageways provided in the piston. The second passageway is located closer to a face of the piston than the first passageway. The first and second passageways are configured to extend between a suction chamber and a discharge chamber of the engine pump according to a pressure at the face of the piston.

Other features and aspects of this disclosure will be apparent from the following description and the accompanying drawings.

DETAILED DESCRIPTION

Figure 1:
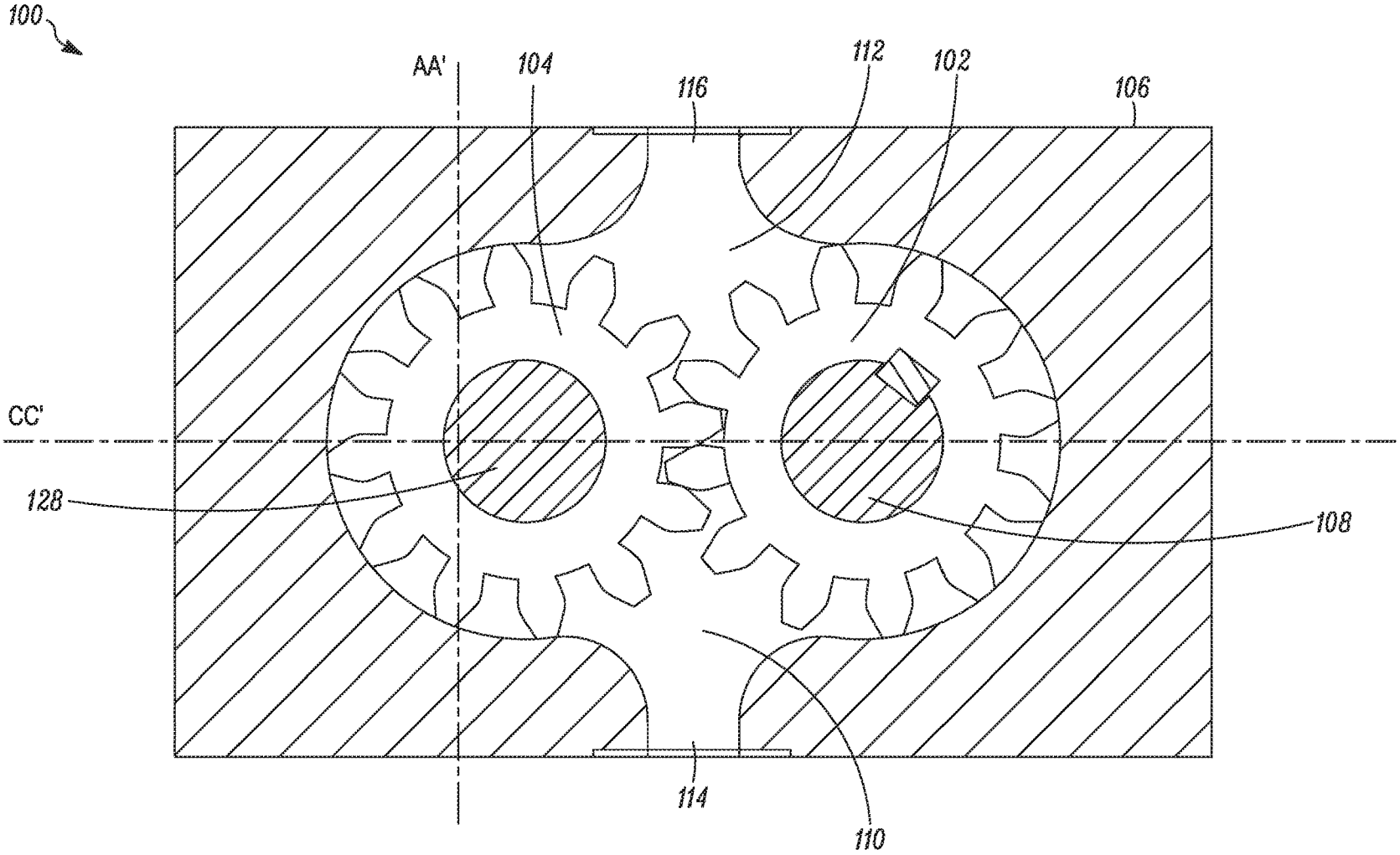
FIG. 1 is a front sectional view of a gear pump, in accordance with embodiments of the present disclosure.

Reference numerals appearing in more than one figure indicate the same or corresponding parts in each of them. References to elements in the singular may also be construed to relate to the plural and vice-versa without limiting the scope of the disclosure to the exact number or type of such elements unless set forth explicitly in the appended claims.

FIG. 1 shows a front sectional view of a pump 100, which according to an embodiment of the present disclosure is embodied in the form of a gear pump. As shown, the pump 100 includes a drive gear 102 and an idle gear 104 located within a housing 106. The drive gear 102 and the idle gear 104 are disposed in mesh with one another. The drive gear 102 is rigidly mounted on a rotatable drive shaft 108 that may be driven using drive power from a prime mover (not shown) e.g., an engine.

Further, as shown in FIG. 1, the pump 100 also includes a suction chamber 110 and a discharge chamber 112 separated by the drive gear 102 and the idle gear 104. The pump 100 further includes a suction port 114 and a discharge port 116 disposed in fluid communication with the suction chamber 110 and the discharge chamber 112 respectively.

Figure 2:
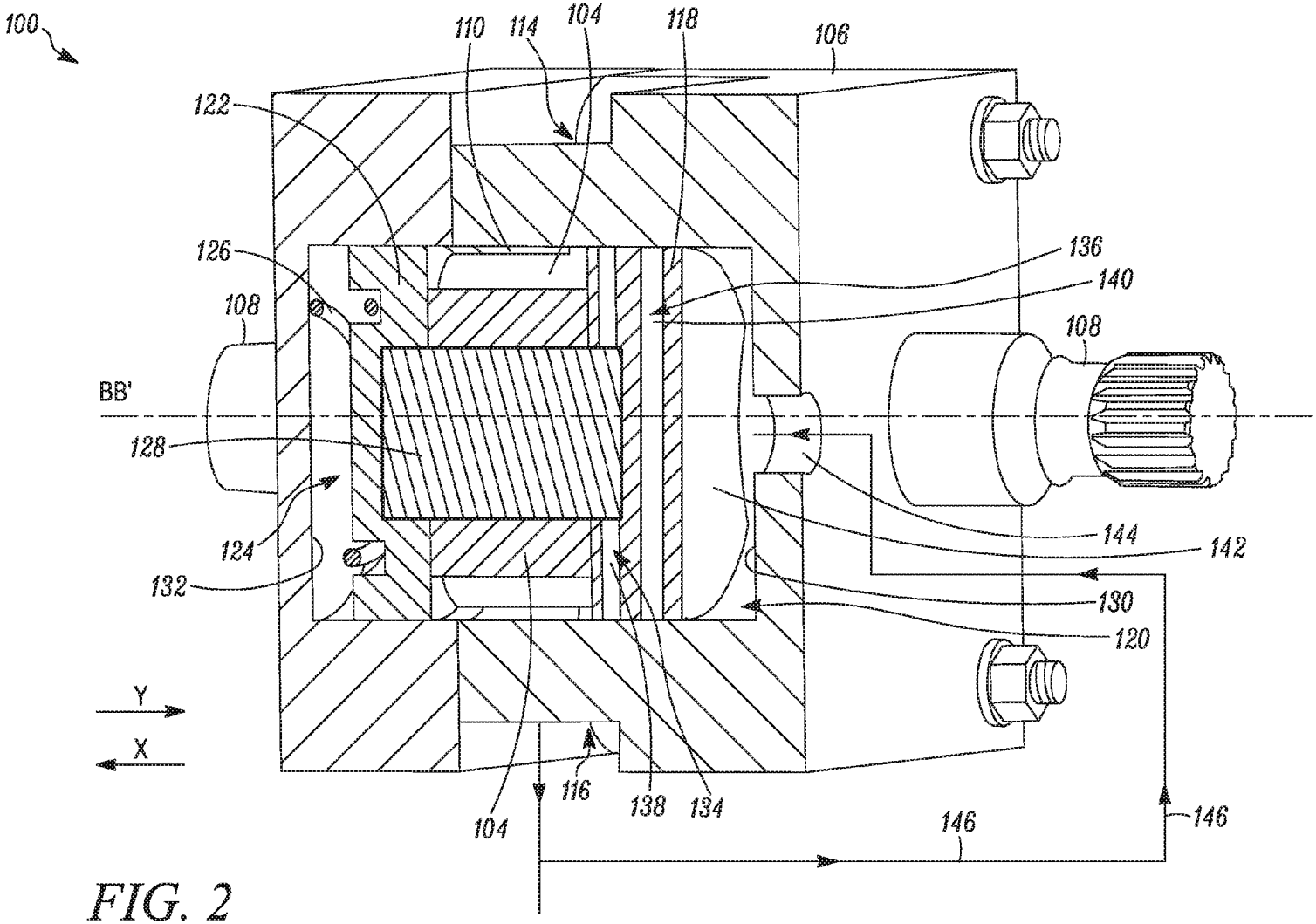
FIG. 2 is a right section view of the gear pump taken along sectional line AA' of FIG. 1, in accordance with embodiments of the present disclosure.
Figure 3:
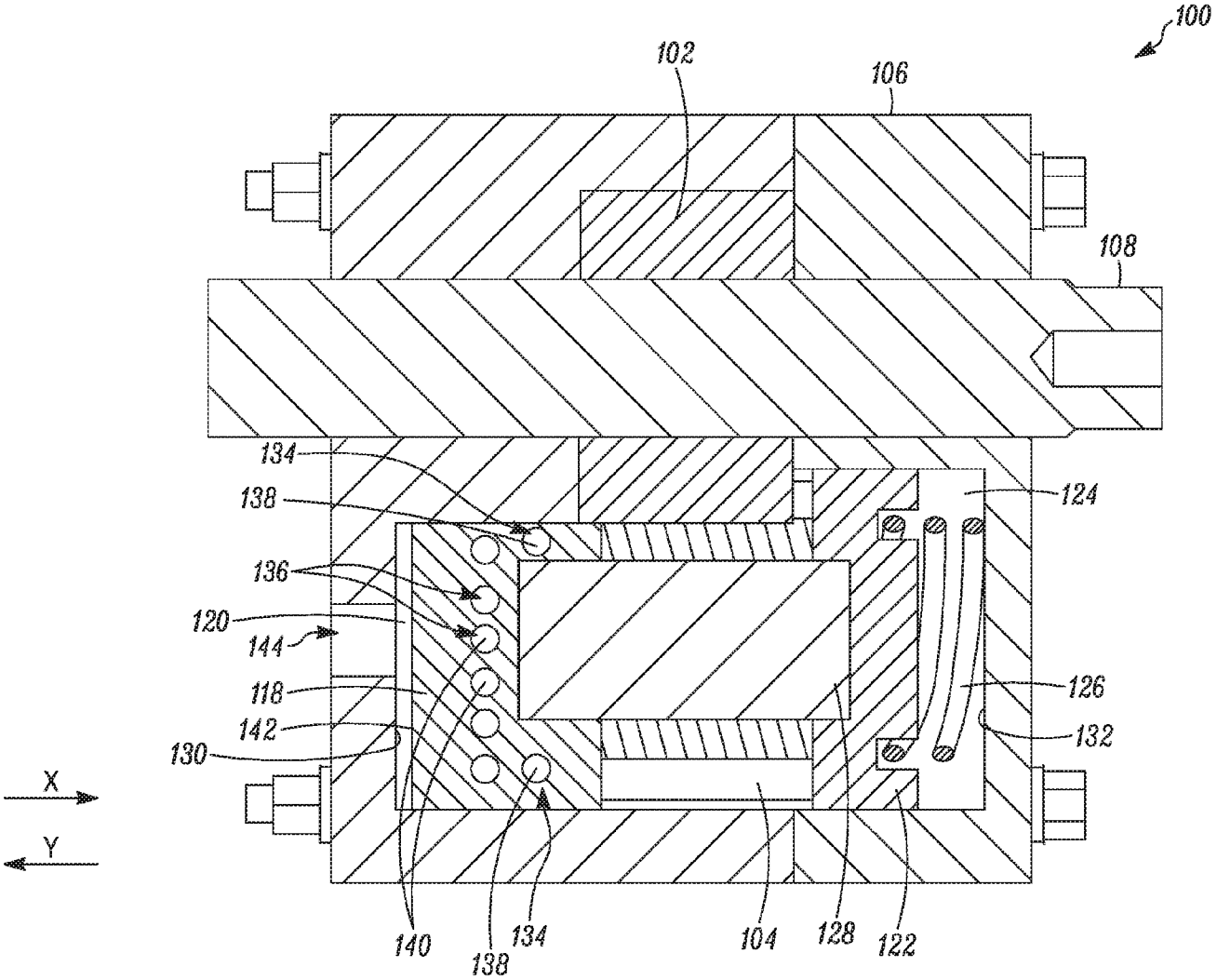
FIG. 3 is a top sectional view of the gear pump taken along sectional line CC' of FIG. 1, in accordance with embodiments of the present disclosure.

Referring to FIGS. 2-3, the pump 100 further includes a piston 118 that is at least partly received within a relief chamber 120 of the pump 100. The pump 100 also includes a second piston 122 at least partly received within a thrust chamber 124. Moreover, as shown, the pump 100 may also include a resilient means 126 provided in the thrust chamber 124. In the illustrated embodiment of FIGS. 2-3, the resilient means 126 is embodied in the form of a spring e.g., a compression spring. However, in other embodiments, other types of resilient means 126 known to persons skilled in the art may be contemplated in lieu of the spring disclosed herein.

As shown in FIGS. 2-3, the piston 118, the idle gear 104, and the second piston 122 are provided on a shaft 128. Moreover, the piston 118 is movable within the relief chamber 120 according to a pressure in the relief chamber 120. The piston 118, the idle gear 104, and the second piston 122 are moveable in either axial direction 'X' or 'Y' between opposing ends 130, 132 of the relief chamber 120 and the thrust chamber 124 respectively.

The piston 118 has first and second passageways 134, 136 provided therein. In the illustrated embodiment of FIGS. 2-4, the first passageway 134 includes a plurality of first apertures 138 while the second passageway 136 includes a plurality of second apertures 140. In embodiments of this disclosure, the second passageway 136 is located closer to a face 142 of the piston 118 than the first passageway 134. Moreover, it is also contemplated that a cross-sectional area of the second passageway 136 i.e., cross-sectional area associated with the plurality of second apertures 140 is greater than a cross-sectional area associated with the first passageway 134 i.e., a cross-sectional area associated with the plurality of the first apertures 138.

Figure 4:
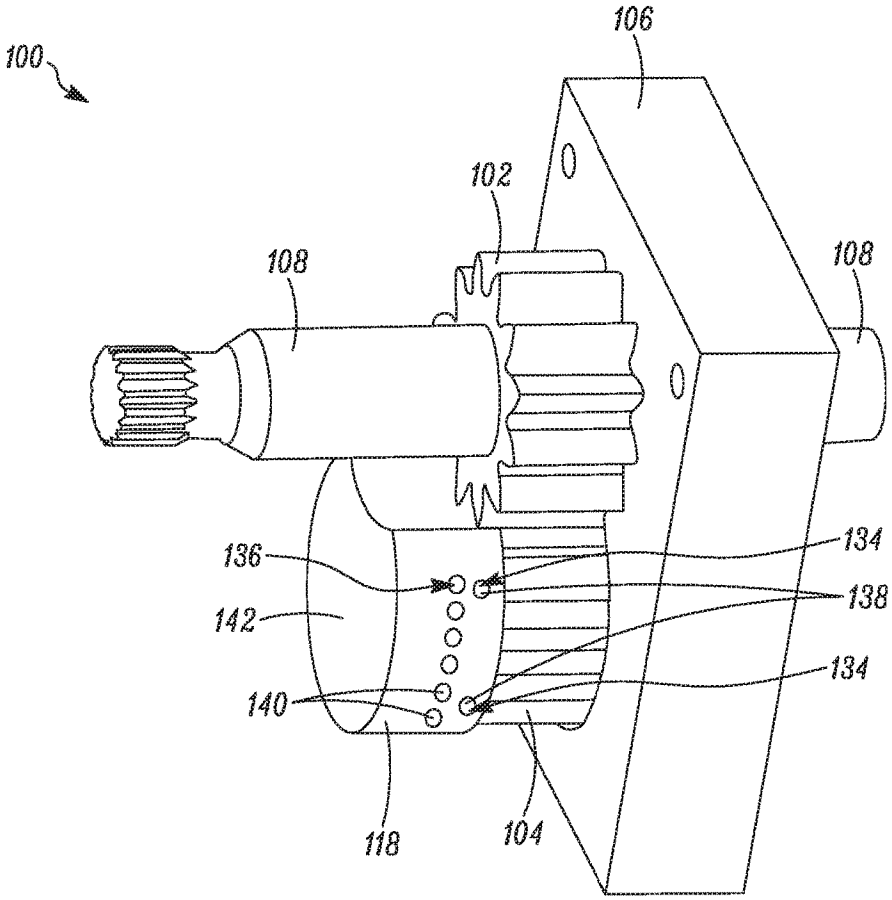
FIG. 4 is a left section view of the gear pump taken along sectional line BB' of FIG. 2, in accordance with one embodiment of the present disclosure.
Figure 5:
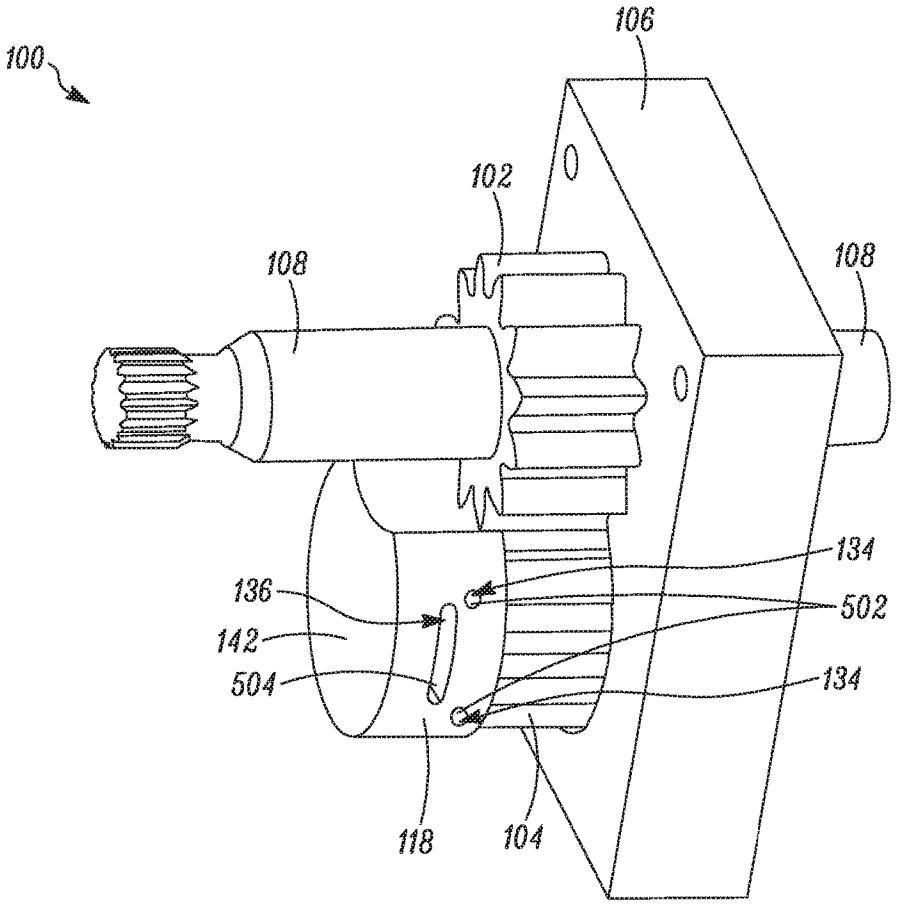
FIG. 5 is a left section view of the gear pump taken along sectional line BB' of FIG. 2, in accordance with another embodiment of the present disclosure.

Although two first apertures 138 and six second apertures 140 are shown in the illustrated embodiment of FIGS. 3-4, a number of first apertures 138 and second apertures 140 provided in the piston 118 is merely exemplary in nature. In an alternative embodiment as shown in FIG. 5, a pair of first apertures 502 are provided in the piston 118 to define the first passageway 134 while a singular second aperture 504 is provided to define the second passageway 136. A cross-sectional area of the second passageway 136 i.e., the singular second aperture 504 is nonetheless maintained greater than a cross-sectional area associated with the first passageway 134 i.e., the pair of first apertures 502.

Further, although a circular cross-section is associated with each of the first and second apertures 138, 140 in the illustrated embodiment of FIGS. 3-4, it may be noted that a cross-section associated with each of the first and second apertures 138, 140 is merely exemplary in nature. In an alternative embodiment as shown in FIG. 5, a cross-section associated with each of the first apertures 138 is circular while the second passageway 136 has a rectangular cross-section formed by way of the slotted second aperture 504 in the piston 118. Therefore, it will be appreciated that any cross-section including, but not limited to, square or elliptical may be used on each of the first and second apertures 138, 140 to implement respective ones of the first and second passageways 134, 136 without limiting the scope of the present disclosure. Also, it may be noted that any number of apertures 138, 140 may be used to form respective ones of the first passageway 134 and the second passageway 136 such that the second passageway 136 is located closer to the face 142 of the piston 118 as compared to the first passageway 134 and in which the cross-sectional area associated with the second passageway 136 is greater than the cross-sectional area associated with the first passageway 134.

As disclosed earlier herein, the piston 118 is moveable within the relief chamber 120 according to a pressure in the relief chamber 120. Referring to FIGS. 2-3, if there is low pressure in the relief chamber 120 then the piston 118, the idle gear 104 and the second piston 122 would be normally biased by a force of the resilient means 126 alone, due to which, a position of the piston 118, the idle gear 104 and the second piston 122 may be located proximal to the end 130 of the relief chamber 120.

Further, if the pressure in the relief chamber 120 increases then the piston 118, the idle gear 104 and the second piston 122 would be biased against a force of the resilient means 126 corresponding to an amount of pressure in the relief chamber 120. If the pressure in the relief chamber 120 is sufficient to overcome the force of the resilient means 126, then the piston 118, the idle gear 104 and the second piston 122 may be configured to axially shift in position along the 'X' direction i.e., towards the end 132 of the thrust chamber 124.

If the pressure in the relief chamber 120 decreases then the force of the resilient means 120, which is in opposing relation to the pressure in the relief chamber 120, may cause the piston 118, the idle gear 104 and the second piston 122 to be biased against the decreasing pressure in the relief chamber 120 corresponding to an amount of decrease in the pressure of the relief chamber 120. In this regard, if the force of the resilient means 126 overcomes the pressure in the relief chamber 120, then the piston 118, the idle gear 104 and the second piston 122 may be configured to axially shift in position along the 'Y' direction i.e., towards the end 130 of the relief chamber 120.

In embodiments of this disclosure, the first and second passageways 134, 136 form fluid paths between the suction chamber 110 and the discharge chamber 112 at a first and second pressure in the relief chamber 120, respectively, in which the first pressure is less than the second pressure. Explanation pertaining to a movement of the piston 118, the idle gear 104 and the second piston 122 in accordance with each of the first and second pressures will be made in conjunction with FIGS. 1-3 and FIGS. 6-9.

Figure 6:
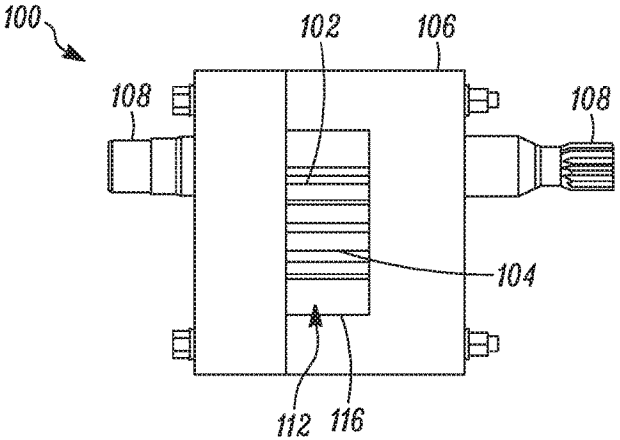

Referring to FIGS. 1-3 and 6, when there is little or no pressure in the relief chamber 120 i.e., the pressure in the relief chamber 120 is less than the first pressure value disclosed herein, then force of the resilient means 126 biases the piston 118, the idle gear 104 and the second piston 122 to their respective pre-defined extreme positions along direction Y in which the idle gear 104 is disposed in a position that allows maximum engagement with the drive gear 102 as shown in FIG. 6. The maximum engagement of the idle gear 104 with the drive gear 102 causes a maximum flow output from the pump 100.

Figure 7:
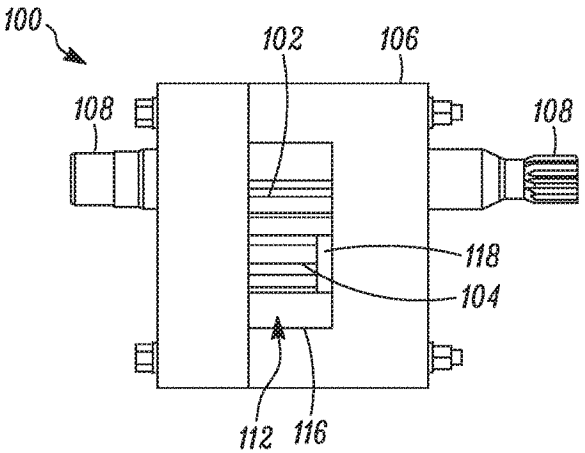
FIGS. 6-9 are left side assembled views of the gear pump showing various stages of operation, in accordance with embodiments of the present disclosure.

Referring to FIGS. 1-3 and 7, as the pressure increases in the relief chamber 120 to a value less than the first pressure value, the pressure in the relief chamber 120 biases the piston 118, the idle gear 104 and the second piston 122 against the force of the resilient means 126 so as to cause a movement of the piston 118, the idle gear 104 and the second piston 122 along direction X in which the idle gear 104 now becomes disposed in partial engagement with the drive gear 102 as shown in FIG. 7. It may be noted that an amount of partial engagement occurring between the idle gear 104 and the drive gear 102 corresponds with an amount of increase in the pressure of the relief chamber 120 that serves to overcome the force of the resilient means 126.

As a partial loss of engagement occurs between the drive gear 102 and the idle gear 104, "slip" occurs thereby causing a reduction in the volumetric efficiency of the pump 100. A displacement of fluid in the pump 100 during partial engagement of the idle gear 104 with the drive gear 102 is therefore less than a displacement of fluid that occurs when the idle gear 104 is in the position of maximum engagement with the drive gear 102. Therefore, pressure in the discharge chamber 112 will decrease and a flow output from the pump 100 during partial engagement of the idle gear 104 with the drive gear 102 would be less than the maximum flow output from the pump 100 obtained during maximum engagement of the idle gear 104 with the drive gear 102.

Figure 8:
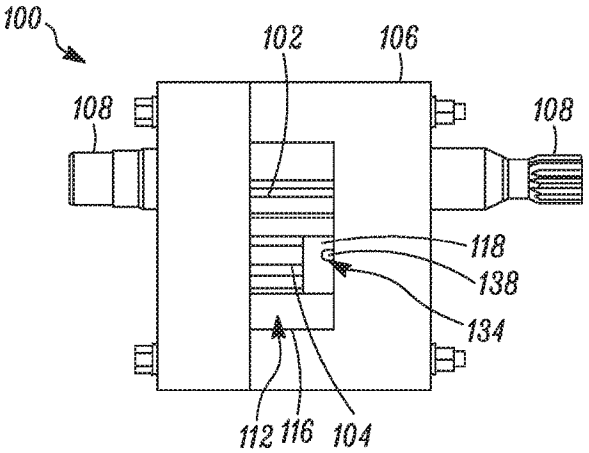

Referring to FIG. 8, if the pressure in the relief chamber 120 of the pump 100 is increased so as to be equal to the first pressure value, the first pressure value of fluid in the relief chamber 120 can bias the piston 118, the idle gear 104 and the second piston 122 against the resilient means 126 i.e., in the direction X such that the first passageway 134 provided in the piston 118 now fluidly communicates the suction chamber 110 with the discharge chamber 112. This way, fluid from the discharge chamber 112 can flow into the suction chamber 110 via the first passageway 134 of the piston 118. An amount of fluid routed through the first passageway 134 causes a reduction in the volumetric efficiency (per revolution) of the pump 100 and a reduction in pressure in the discharge chamber 112. In this manner, a flow output from the pump 100 may be reduced to a value less than that obtained during partial engagement of the idle gear 104 with the drive gear 102 described above with reference to FIG. 7. It may be noted that a maximum amount of fluid that can be re-routed to the suction chamber 110 using the first passageway 134 depends on the cross-sectional area associated with the first passageway 134.

Figure 9:
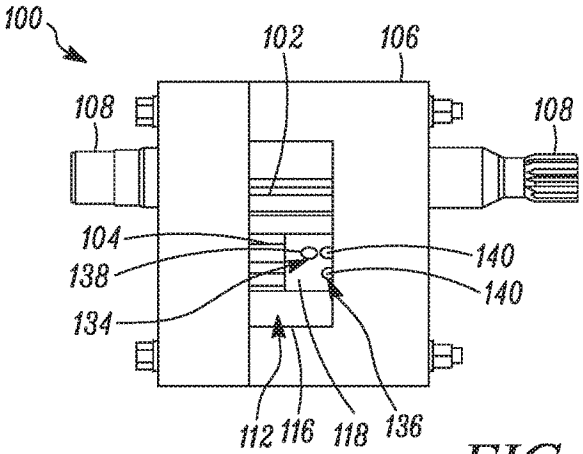

Referring to FIG. 9, if the pressure in the relief chamber 120 of the pump 100 increases so as to be equal to the second pressure value which, as disclosed earlier herein, is greater than the first pressure value then the second pressure value of fluid in the relief chamber 120 biases the piston 118, the idle gear 104 and the second piston 122 against the resilient means 126 i.e., in the direction X such that both the first passageway 134 and the second passageway 136 provided in the piston 118 can now fluidly communicate the suction chamber 110 with the discharge chamber 112. Fluid from the discharge chamber 112 can then flow to the suction chamber 110 via both the first and second passageways 134, 136 of the piston 118. An amount of fluid routed through the first and second passageways 134, 136 causes a further reduction in the volumetric efficiency of the pump 100. This way, a flow output from the pump 100 may be reduced to a value less than that obtained when the first passageway 134 alone is configured to communicate fluid from the discharge chamber 112 to the suction chamber 110. It may be noted that a maximum amount of fluid that can be re-routed to the suction chamber 110 using the first and second passageways 134 now depends on the cross-sectional areas associated with respective ones of the first and second passageways 134, 136.

In an embodiment as shown in FIG. 2, the relief chamber 120 is provided with an inlet port 144. The pump 100 also includes a fluid passageway 146 connecting the discharge chamber 112 and the relief chamber 120 i.e., the inlet port 144 of the relief chamber 120. With the arrangement of the fluid passageway 146, fluid discharged by the pump 100 via the discharge port 112 can be beneficially used to regulate a pressure in the relief chamber 120, and the pressure in the relief chamber 120 may correspond with i.e., be equal to the pressure in the discharge chamber 112. In embodiments of this disclosure, it should also be noted that the discharge chamber 112 generally remains loaded with pressure downstream of the discharge chamber 112 and this pressure may be advantageously used to regulate the pressure in the relief chamber 120.

Moreover, it may be noted that although the fluid passageway 146 is shown located external to the housing 106 of the pump 100 in the illustrated embodiment of FIG. 2, in other embodiments, the fluid passageway 146 may alternatively be embodied in the form of a conduit that is located within the housing 106 of the pump 100. In this configuration, the pressure in the relief chamber 120 would correspond with pressure in the discharge chamber 112, whereby the first and second pressure values may be chosen to regulate operation of the pump. Persons skilled in the art will appreciate that various configurations of the fluid passageway 146 between the discharge chamber 112 and the relief chamber 120 can be contemplated and such configurations of the fluid passageway 146 may impart flexibility to manufacturers in designing the pump 100 of the present disclosure to meet specific requirements of an application.

Various embodiments disclosed herein are to be taken in the illustrative and explanatory sense, and should in no way be construed as limiting of the present disclosure. All joinder references (e.g., attached, affixed, provided, coupled, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure has applicability for use and implementation in regulating a pressure of fluid supplied from a pump to a hydraulic system located downstream of the pump. As known to persons skilled in the art, conventional gear pumps are configured to merely vary a displacement of fluid by the pump within its operating range.

Embodiments of the present disclosure allow the idle gear 104 to be axially displaced in relation to the drive gear 102 so that an engagement of the idle gear 104 with the drive gear 102 can be varied to vary fluid output from the pump 100 in response to a pressure of fluid in the relief chamber 120. Moreover, during operation of the pump 100, if the pressure of fluid in the relief chamber 120 reaches the first pressure value, fluid from the discharge chamber 112 can flow into the suction chamber 110 via the first passageway 134. The amount of fluid routed by the first passageway 134 is dependent upon the cross-sectional area of the first passageway 134 that serves to fluidly communicate the discharge chamber 112 with the suction chamber 110.

If the pressure of fluid in the relief chamber 120 reaches the second pressure value, the second pressure value greater than the first pressure value, a greater amount of fluid from the discharge chamber 112 can flow to the suction chamber 110 by the first and second passageways 134, 136. As disclosed earlier herein, the amount of fluid routed by the first and second passageways 134, 136 (in unit time) is greater than an amount of fluid routed by the first passageway 134 alone.

With use of embodiments disclosed herein, gear pumps can be configured to advantageously regulate a flow output from the pump to match with pressure requirements of downstream systems. Further, the first pressure value may be chosen, in one embodiment, to accord with a pressure value representing excess stress within the pump such as excess gear contact stress. The second pressure value may be chosen, in one embodiment, to accord with a pressure value close to a maximum safe pressure of the pump or chosen downstream components. In this manner, users of gear pumps can conveniently mitigate the possibility of damaging pressure sensitive components such as, but not limited to, seals associated with the pump itself or with the downstream systems.

A further advantage conferred by the implementation of embodiments disclosed herein is that the additional costs previously incurred with the use of conventional pressure regulators and safety valves previously installed downstream of conventional gear pumps can be reduced or avoided. The first and second pressure values may be chosen to provide, for instance, safety value capability within the pump.

While aspects of the present disclosure have been particularly shown and described with reference to the embodiments above, it will be understood by those skilled in the art that various additional embodiments may be contemplated by the modification of the disclosed machines, systems, methods and processes without departing from the spirit and scope of what is disclosed. Such embodiments should be understood to fall within the scope of the present disclosure as determined based upon the claims and any equivalents thereof.

What is claimed is:

1. A pump for an engine, comprising:

a drive gear rigidly mounted on a rotatable drive shaft;

an idle gear mounted on a shaft and being engaged with the drive gear;

a suction chamber and a discharge chamber;

a piston at least partly received within a relief chamber, the piston having first and second passageways provided therein, wherein the second passageway is closer to a face of the piston than the first passageway; and a fluid passageway connecting the discharge chamber and the relief chamber, wherein the piston is movable within the relief chamber according to a pressure in the relief chamber, and wherein the first and second passageways form fluid paths between the suction chamber and the discharge chamber at a first and second pressure in the relief chamber, respectively, the first pressure being less than the second pressure.

2. The pump of claim 1, wherein the second passageway has a greater cross-sectional area than the first passageway.

3. The pump of claim 1, wherein the first passageway comprises a plurality of first apertures.

4. The pump of claim 1, wherein the second passageway comprises a plurality of second apertures.

5. The pump of claim 1, wherein the second passageway comprises a slot.

6. The pump of claim 1, wherein the pump is a gear pump, whereby the drive gear and the idle gear separate the suction chamber and the discharge chamber.

7. The pump of claim 6, wherein the piston, the idle gear, and a second piston are provided on the shaft, the second piston at least partly received within a thrust chamber, and wherein resilient means are provided in the thrust chamber, the resilient means bearing on the second piston.

8. The pump of claim 7, wherein the resilient means comprises a spring.

9. The pump of claim 1, wherein the fluid passageway is integral with a housing of the pump.

10. The pump of claim 1, wherein the relief chamber is provided with an inlet port.

11. The pump of claim 1, wherein a pressure value of the first pressure corresponds with a pressure value representing excess stress within the pump.

12. The pump of claim 1, wherein a pressure value of the second pressure corresponds with a pressure value at or about a maximum operating pressure of the pump.

13. A piston for an engine pump, comprising:

first and second passageways provided in the piston, wherein the second passageway is closer to a face of the piston than the first passageway;

wherein the first and second passageways extend between a suction chamber and a discharge chamber of the engine pump according to a pressure at the face of the piston, wherein the piston is configured to be at least partly received within a relief chamber, wherein the piston is movable within the relief chamber according to a pressure in the relief chamber, wherein the first and second passageways form fluid paths between the suction chamber and the discharge chamber at a first and second pressure in the relief chamber, respectively, the first pressure being less than the second pressure, and wherein a fluid passageway connects the discharge chamber and the relief chamber.

14. The piston of claim 13, wherein the second passageway has a greater cross-sectional area than the first passageway.

15. The piston of claim 13, wherein the first passageway comprises a plurality of first apertures.

16. The piston of claim 13, wherein the second passageway comprises a plurality of second apertures.

17. The piston of claim 13, wherein the second passageway comprises a slot.

* * * * *